United States Patent [19]

Ampferer

[11] Patent Number: 4,493,295

[45] Date of Patent: Jan. 15, 1985

[54] INTERNAL COMBUSTION ENGINE, ESPECIALLY FOR MOTOR VEHICLES

[75] Inventor: Herbert Ampferer, Bietigheim-Bissingen, Fed. Rep. of Germany

[73] Assignee: Dr. Ing. h.c.F. Porsche A.G., Fed. Rep. of Germany

[21] Appl. No.: 511,477

[22] Filed: Jul. 7, 1983

[30] Foreign Application Priority Data

Jul. 8, 1982 [DE] Fed. Rep. of Germany ..... 3225478

[51] Int. Cl.[3] ..... F01M 13/00

[52] U.S. Cl. ..... 123/41.86; 123/196 CP; 123/572

[58] Field of Search ..... 123/41.86, 41.33, 196 R, 123/196 S, 195 C, 572, 573

[56] References Cited

U.S. PATENT DOCUMENTS

| | | | |
|---|---|---|---|
| 2,493,617 | 1/1950 | Chubbuck | 123/41.86 |
| 2,855,910 | 10/1958 | DeWaern | 123/41.86 |
| 3,279,444 | 10/1966 | Leasure | 123/41.86 |

FOREIGN PATENT DOCUMENTS

| | | | |
|---|---|---|---|
| 1916788 | 11/1978 | Fed. Rep. of Germany | 123/41.86 |

*Primary Examiner*—William A. Cuchlinski, Jr.
*Attorney, Agent, or Firm*—Craig & Burns

[57] ABSTRACT

An internal combustion engine, especially for motor vehicles, includes separate oil return and vent channels extending between a crank space of a cylinder crankcase and a valve-actuating space formed by a cylinder head and a cover. For the defined and separate guidance of the media passing through the oil return channels and vent channels, the oil return channels are arranged at a distance to the vent channels and the vent channels are connected to an air guide device inside of the valve-actuating space.

21 Claims, 2 Drawing Figures

INTERNAL COMBUSTION ENGINE, ESPECIALLY FOR MOTOR VEHICLES

Figure 2:
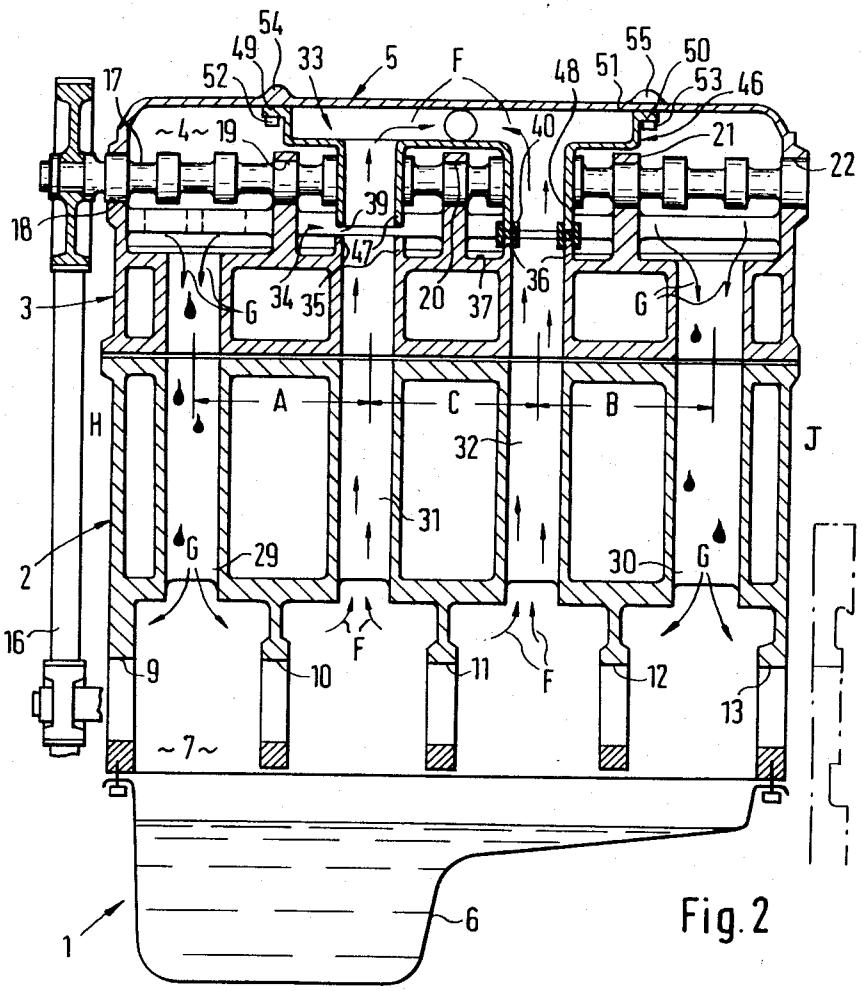

The present invention relates to an oil return and crankcase venting arrangement for an internal combustion engine, especially for motor vehicles, which includes a cylinder crankcase and a cylinder head that is provided with a cover. At least one oil return and one venting channel extends between a crank space of the cylinder crankcase and a valve-actuating space formed by the cover and the cylinder head, the two spaces being separate from one another.

It is known to construct the cylinder crankcase of an internal combustion engine to have oil return channels and vent channels. However, it has been found in practice that during the operation of such as internal combustion engine, the excess pressure prevailing in these channels at least impairs an operationally correct oil return and, at times, oil present in the valve-actuating space may leave by way of the oil filler pipe of the valve cover and possibly even may reach the air filter.

One suggested approach for avoiding this disadvantage (German Offenlegungsschrift No. 22 42 263) is to insert a relatively small vent pipe into the oil return line which protrudes above the oil level in the valve-actuating space. This construction entails the disadvantage that a defined venting operation and oil return is very difficult with this arrangement since no measures are taken to positively guide the venting medium through only the small vent pipe, i.e., it cannot be excluded that a part of the venting medium reaches the valve-actuating space by way of the oil return channel. Additionally, the cross-section ratio of the vent pipe to the oil return channel is so unfavorable that a completely satisfactory removal of the venting medium can be hardly realizable because of the quantity which would of necessity have to pass through the small vent pipe. Finally, a secure mounting of the small vent pipe in the oil return channel is problematical with the indicated means since the inside of the oil return channel is not machined. Thus, unfavorable tolerance may occur which prevent the insertion of the pipe or preclude a positionally fixed mounting of the support ribs.

It is the aim of the present invention to so arrange and construct the oil return and vent channels in an internal combustion engine that a defined and separate guidance of the media passing through the same is assured.

The underlying problems are solved according to the present invention in that the oil return channel is disposed at a distance to the vent channel and in that the vent channel is connected inside the valve-actuating mechanism to an air guide device in such a manner that the medium flowing through the vent channel is guided substantially independently of the oil return channel and preferably leaves the internal combustion engine within the area of the cover.

The advantages principally achieved with the present invention reside in that the vent channel disposed at a distance to the oil return channel is an separated by an air guidance device in the cover so that both media (oil and gas) safely pass through respective channel without mutually interfering. A collar of the vent channel protrudes beyond the intermediate bottom of the cylinder head and prevents a penetration of oil into the vent channel. Ordinarily, a safe removal of the venting medium will also be possible if a small gap remains between collar and air guide device. Insofar as a complete separation of the vent channel is desired, a sealing body may be provided between the air guide device and the cylinder head, preferably between collar and the air guide device.

When the vent channel is delimited by outer walls of the crankcase and of the cylinder head, then the air guide device can be easily connected thereto. The air guide device is formed by outer walls of the cylinder head and of the cover as well as by a wall of an insert member and can thus be integrated in a simple manner into an internal combustion engine. The insert member is a structural part which can be readily manufactured and which can be secured to the cover without problem.

If a four-cylinder internal combustion engine which is installed transversely into the vehicle includes two outer oil return channels and two vent channels disposed therebetween, then it is assured that during fast and long curves no oil will reach the vent channels.

A good venting action with spatially favorable arrangement is achieved by the guidance of the venting medium from the one side to the other side of the internal combustion engine.

Figure 1:
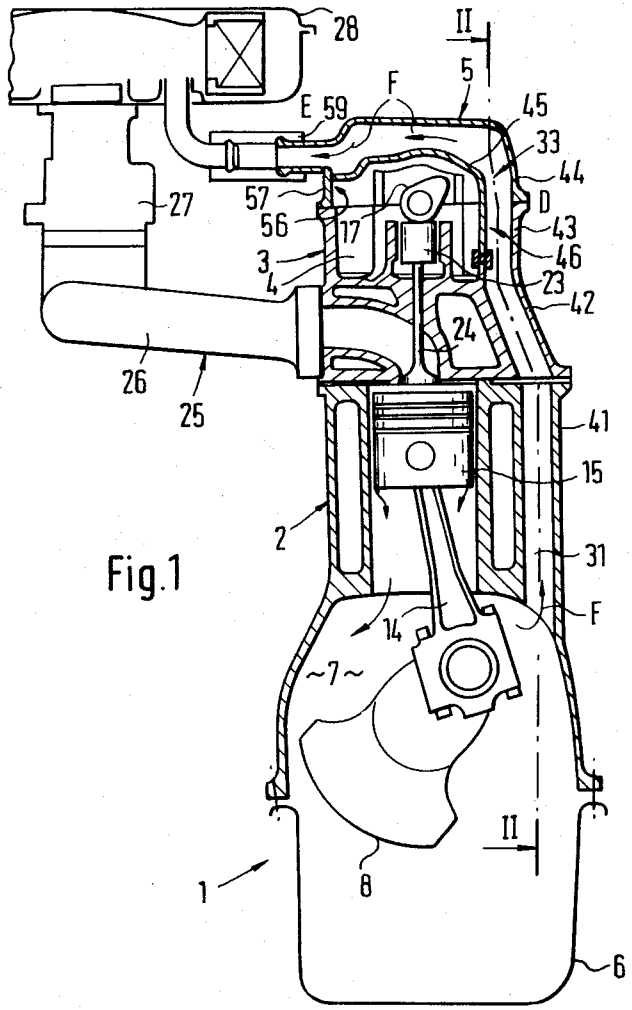

These and other objects, features and advantages of the present invention will become more apparent from the following description when taken in connection with the accompanying drawing which shows, for purposes of illustration only, one embodiment in accordance with the present invention, and wherein:

FIG. 1 is a transverse cross-sectional view through an internal combustion engine in accordance with the present invention; and FIG. 2 is a cross-sectional view, taken along line II—II of FIG. 1.

Referring now to the drawing wherein like reference numerals are used throughout the two views to designate like parts, an internal combustion engine generally designated by reference numeral 1 includes a cylinder crankcase generally designated by reference numeral 2, a cylinder head generally designated by reference numeral 3 and a cover generally designated by reference numeral 5 securely connected with the cylinder head 3 and surrounding a valve-actuating space 4.

The cylinder crankcase 2 has an oil pan 6 bolted thereto which along with the crankcase 2, delimits a crank space 7 of the cylinder crankcase.

A crankshaft 8 is provided inside of the crank space 7 which includes bearings 9, 10, 11, 12, 13 and is connected by way of a connecting rod 14 with a piston 15 (only one piston rod and piston is shown). The crankshaft 8 drives by way of a toothed belt 16 a cam shaft 17 arranged above in the cylinder head 3 (overhead cam shaft). The cam shaft 17 for which the bearings 18, 19, 20, 21 and 22 are provided actuates a valves 24 (only one valve is shown) by means of a tappet or rocker 23 (only one of which is shown).

A fuel preparation system 25 is connected with the internal combustion engine 1 which includes a suction line 26, a carburetor 27 and an air filter 28.

Oil return channels 29, 30 and venting channels 31, 32 extend in the vertical direction between the crank space 7 and the valve-actuating space 4 of the internal combustion engine and are arranged at distances A and B relative to one another (FIG. 2). The vent channels 31 and 32 are disposed at a distance C to one another and are connected inside of the valve-actuating space 4 to an air-guide device 33 which assures that the medium flowing through the vent channels 31, 32 leaves the internal combustion engine 1 within the area of the cover 5.

The vent channels 31, 32 are provided within the connecting area 34 of the air guide device 33 with collars 35, 36 which protrude above an intermediate bottom 37 of the cylinder head and which assure that the oil deposited at the intermediate bottom is prevented from entering the vent channels 31 and 32. A relatively small gap 39 remains between the collar 35 and the air guide device 33; however, the possibility also exists of providing a sealing body 40 between the air guide device and the collar 36 and the intermediate bottom 37 of the cylinder head 3. Additionally, it is also feasible that the collars 35, 36 overlap the air guide device 33 or vice versa.

According to FIG. 1, the vent channel 31 is delimited by outer wall 41 of the cylinder crankcase 2 and outer wall 42 of the cylinder head 3 whereby a spatially favorable arrangement of the vent channels 31, 32 and possibly also of the oil return channels 29, 30 is created.

The air guide device 33 is delimited by outer walls 43 of the cylinder head 3 and outer wall 44 of the cover 5 as well as by a wall 45 of an insert member 46.

The insert 46 includes channel sections 47, 48 which are connected to the collars 35, 36. Additionally, the insert 46 is provided with fastening flanges 49, 50 which are extended up to an upper wall 51 of the cover 5 and are retained by means of bolts 52, 53 which extend through the fastening flanges 49, 50. Thickened portions 54, 55 for threaded bores (not shown in detail) are provided locally at the wall 51 within the area of the bolts 52 and 53. The wall 45 of the insert member 46 of the guide device 33 extends (FIG. 1) from the right side D to the left side E. It thereby surrounds the cam shaft 17 and is connected at 56 to a wall 57 of the cover 5 which is adjacent the air filter 28. A line 59 is arranged between the wall 57 and the air filter 28, by way of which the venting medium (arrows F) is fed to the air filter 28. The oil flows corresponding to the arrows G fom the valve-actuating space 4 into the crank space 7.

The venting channels 31, 32 are provided between the oil return channels 29 and 30 which in turn are adjacent the end faces H and J of the internal combustion engine 1. If the internal combustion engine is installed transversely into a vehicle, for example, for space reasons, then it is assured by the arrangement of the venting channels 31, 32 between the outwardly disposed oil return channels 29, 30 that when the vehicle is driven fast on long curves, no oil can reach the venting channels 31, 32 since the oil is displaced toward the side H or J by reason of the transverse acceleration.

The oil return channels 29, 30 and the venting channels 31, 32 have approximately the same cross section and the same distance to one another in the illustrated embodiment. However, it is also possible to provide different cross sections and spacings.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An internal combustion engine having a cylinder crankcase and cylinder head provided with a cover, said cylinder crankcase including a crank space and said cylinder head and cover delimiting a valve-actuating space, the engine comprising at least one oil return channel means for returning oil from said valve-actuating space to said crank space and at least one vent channel means for passage of venting medium from said crank space, said at least one oil return channel means and said at least one vent channel means extending between said crank space of the cylinder crankcase and said valve-actuating space formed by the cover and the cylinder head, said at least one oil return means and said at least one vent channel means being separate and disposed at a distance from one another, guide means disposed within said valve-actuating space for guiding venting medium from said at least one vent channel means, the at least one vent channel means air guide means cooperating inside of the valve-actuating space in such a manner that the venting medium flowing through the at least one vent channel means is guided substantially independently of medium flowing in the at least one oil return channel means.

2. An internal combustion engine according to claim 1, wherein the guide means is disposed such that the venting medium flowing through the at least one vent channel means leaves the internal combustion engine within the area of the cover means.

3. An internal combustion engine according to claim 2, wherein the at least one vent channel means includes an oil-retaining collar means extending within a connecting area of the air guide means, whereby a relatively narrow gap remains between collar means and air guide means.

4. An internal combustion engine according to claim 1, wherein the at least one vent channel means includes an oil-retaining collar means extended within a connecting area of the air guide means, whereby a relatively narrow gap remains between the collar means and the air guide means.

5. An internal combustion engine according to claim 4, wherein a sealing body means is provided between the cylinder head and the air guide means.

6. An internal combustion engine according to claim 5, wherein the sealing body means is provided between the collar means and the air guide means.

7. An internal combustion engine according to claim 1, wherein, as viewed in a cross section of the internal combustion engine, at least the at least one vent channel means is delimited by outer walls of the cylinder crankcase and of the cylinder head.

8. An internal combustion engine according to claim 7, wherein the air guide means is formed by outer walls of the cylinder head and of the cover and a wall of an insert means.

9. An internal combustion engine according to claim 8, wherein the insert means includes a channel section which is connected to the collar means of the at least one vent channel means.

10. An internal combustion engine according to claim 9, wherein the insert means includes fastening flanges extending up to the cover.

11. An internal combustion engine according to claim 10, wherein the insert means is retained at the cover by bolts extending through the fastening flanges.

12. An internal combustion engine according to claim 9, wherein, the engine is installed transversely in the front of a vehicle and as viewed in a longitudinal cross section of the internal combustion engine, said at least one channel means includes two vent channel means arranged between two outwardly disposed oil return channel means.

13. An internal combustion engine according to claim 12, wherein the engine is of a four-cylinder in-line type of construction.

14. An internal combustion engine according to claim 12, wherein the engine includes an overhead cam shaft and a fuel preparation means including an air filter and as viewed in a cross section of the internal combustion engine, the air filter is provided above the fuel preparation means arranged laterally to one side of the internal combustion engine, and the vent channel means extends along the other side of the internal combustion engine, whereby the air guide means surrounds the cam shaft with the wall of the insert means and is connected to the wall of the cover adjacent the air filter.

15. An internal combustion engine according to claim 1, wherein the air guide means is formed by outer walls of the cylinder head and of the cover and a wall of an insert means.

16. An internal combustion engine according to claim 15, wherein the at least one vent channel means includes a collar and the insert means includes a channel section which is connected to the collar.

17. An internal combustion engine according to claim 15, wherein the insert means includes fastening flanges extending up to the cover.

18. An internal combustion engine according to claim 17, wherein the insert means is retained at the cover by bolts extending through the fastening flanges.

19. An internal combustion engine according to claim 1, wherein the engine is installed transversely in the front of a vehicle and, as viewed in a longitudinal cross section of the internal combustion engine, the at least one vent channel means includes two vent channel means arranged between two outwardly disposed oil return channel means.

20. An internal combustion engine according to claim 1, wherein the engine includes an overhead cam shaft and a fuel preparation means including an air filter and, as viewed in a cross section of the internal combustion engine, the air filter is provided above the fuel preparation means arranged laterally to one side of the internal combustion engine and the at least one vent channel means extends along the other side of the internal combustion engine, whereby the air guide means surrounds the cam shaft with the wall of an insert means and is connected to the wall of the cover adjacent the air filter.

21. An internal combustion engine according to claim 20, wherein the engine is installed transversely in the front of a vehicle and, as viewed in a longitudinal cross section of the internal combustion engine, the at least one vent channel means includes two vent channel means arranged between two outwardly disposed oil return channel means.

* * * * *